US005737992A

United States Patent [19]

Torrekens et al.

[11] Patent Number: 5,737,992

[45] Date of Patent: Apr. 14, 1998

[54] METHOD AND DEVICE FOR CONTROLLING A DOUBLE-ACTING CYLINDER ACTUATED BY A PRESSURIZED FLUID

[75] Inventors: Daniel Octaaf Ghislain Torrekens, Rue de la Station 22, 7850 Enghien; Didier Pacco, Herne, both of Belgium

[73] Assignee: Daniel Octaaf Ghislain Torrekens, Enghien, Belgium

[21] Appl. No.: 635,896

[22] PCT Filed: Oct. 28, 1994

[86] PCT No.: PCT/BE94/00079

§ 371 Date: Apr. 25, 1996

§ 102(e) Date: Apr. 25, 1996

[87] PCT Pub. No.: WO95/11777

PCT Pub. Date: May 4, 1995

[30] Foreign Application Priority Data

Oct. 29, 1993 [BE] Belgium ..... 9301196

[51] Int. Cl.[6] ..... F01C 21/12; F15B 13/16

[52] U.S. Cl. ..... 91/59; 91/361; 91/459; 91/465

[58] Field of Search ..... 91/59, 361, 459, 91/462, 465

[56] References Cited

U.S. PATENT DOCUMENTS

| | | | |
|---|---|---|---|
| 4,201,099 | 5/1980 | Junkers . | |
| 4,628,499 | 12/1986 | Hammett | 91/361 X |
| 4,805,496 | 2/1989 | Wagner et al. . | |
| 5,105,719 | 4/1992 | Yoshikawa | 91/59 |
| 5,230,272 | 7/1993 | Schmitz | 91/361 |
| 5,421,240 | 6/1995 | Ohta et al. | 91/59 |

FOREIGN PATENT DOCUMENTS

| | | |
|---|---|---|
| 3416881 | 5/1984 | Germany . |
| 3620753 | 6/1986 | Germany . |
| 2199163 | 11/1986 | United Kingdom . |

*Primary Examiner*—Hoang Nguyen

[57] ABSTRACT

Method for controlling a pressurized fluid-actuated double acting cylinder in an assembly such as a hydraulic tightening spanner (1) with a control unit therefor, wherein a piston (5) may be reciprocated repeatedly, firstly with an active stroke providing a desired maximum force, and then with an opposed passive stroke returning the piston (5) to its starting point to enable repetition, and wherein said method comprises selecting a set fluid pressure corresponding to the desired maximum force (Fr) and measuring the time elapsed (Te) between the beginning and the end of the passive return stroke to determine that the force has been achieved. A device for implementing the force is also disclosed.

9 Claims, 2 Drawing Sheets

Figure 1:
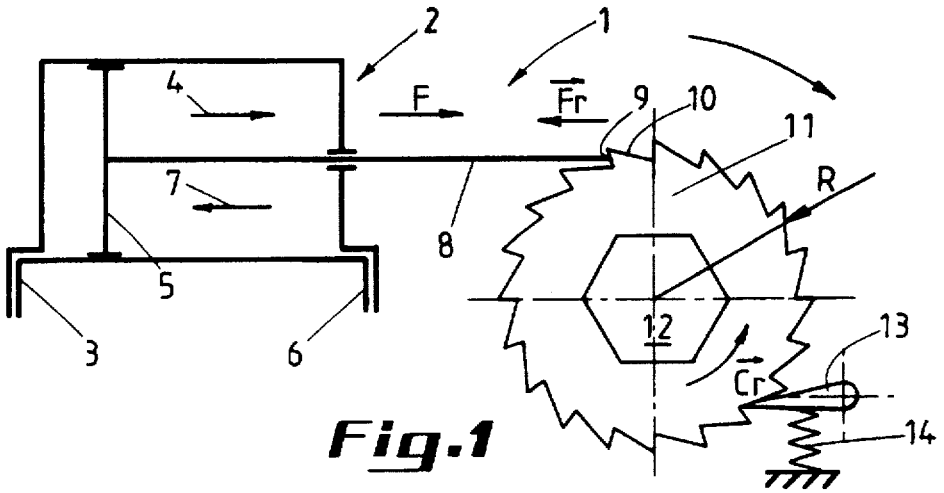

METHOD AND DEVICE FOR CONTROLLING A DOUBLE-ACTING CYLINDER ACTUATED BY A PRESSURIZED FLUID

The present invention relates to a method for controlling a double-acting cylinder actuated by a pressurized fluid in an assembly, such as a hydraulic tightening wrench and its control unit, in which a to-and-fro movement of a piston may be repeated, an active stroke of which piston provides a desired maximum force and a so-called passive stroke, in the reverse direction to the active stroke, causes the piston to return for the repetition.

When using a hydraulic tightening wrench described, for example, in U.S. Pat. No. 4,201,099 or in DE-A-3,620,753 and DE-A-3,416,881, it is necessary, on the one hand, to monitor the moment when the supply pressure for the cylinder in the tightening active-stroke direction reaches a desired value corresponding to the desired tightening torque (the tightening torque obtained is proportional to the force caused by the cylinder and this force is itself proportional to said supply pressure) and, on the other hand, to check that this value is reached during said active stroke and not at the end of it. The reason for this is that, at the end of this active stroke, as the supply for the cylinder is maintained in this direction, the pressure of this supply increases to the point where it may be confused with the pressure corresponding to the desired tightening torque. In order to avoid this confusion, an end-of-active-stroke sensor could be provided and the signal communicated by this sensor could be used.

The object of the present invention is to avoid the use of such a sensor, or of any other auxiliary device of this kind, which it is necessary to mount in the tightening wrench, which it is necessary to supply with power from the outside in order for it to operate and from which it is necessary to extract the end-of-stroke signal in order to bring it to a means for using the latter. The costs of installing such a sensor in the tightening wrench are considerable compared to those of the wrench itself and the incorporation of this sensor into the latter, often used under high stress conditions, especially in the active-stroke direction, increases the risk of the tightening wrench malfunctioning, for example through false information being provided by said sensor.

The method of the present invention is developed in order to exploit, to the maximum and in a reliable manner, preferably automatically by means of programmable devices, the information supplied by means of detection and of measurement of the hydraulic pressure, these means being provided outside the hydraulic wrench proper.

For this purpose, the method according to the invention comprises:

- selection of a set pressure for the fluid, corresponding to the desired maximum force;
- supply of the cylinder with pressurized fluid in the direction of the active stroke:
- detection of the fact that, during the active stroke, the pressure of the fluid reaches the set pressure;
- following this detection, reversed supply of the cylinder with pressurized fluid, for the passive return stroke;
- detection of the moment when the piston has completed its passive return stroke;
- measurement of the time elapsed between the start of the reversed supply and the moment when the completion of the passive return stroke is detected;
- comparison of this elapsed time with a time which has been determined as corresponding substantially to that of a complete passive return stroke; and

- repetition of the above sequence, at least until said measured elapsed time is substantially less than the determined time.

The present invention also )relates to a device for implementing the abovementioned method.

According to the invention, the device comprises:

- means of selection of a set pressure for the fluid, as a function of a maximum force desired during an active stroke of the piston of the cylinder;
- connected to these means of selection, means of comparison of a pressure of the fluid during the active stroke of the piston, and optionally its passive return stroke, and of the set pressure;
- connected to these means of comparison, means of input and of matching of a signal of the pressure supplied to the cylinder during its active stroke and optionally its passive return stroke;
- connected to the means of comparison, means of selective control of the cylinder for the active stroke and for the passive return stroke;
- connected to the means of comparison, means of detection of the end of the passive return stroke;
- connected to the means of comparison, means of measurement of the time elapsed between the start of the passive return stroke and the completion thereof; and
- connected to the means of comparison, means of memory storage of a time determined as corresponding substantially to that of a complete passive return stroke.

Other details and features of the invention will appear from the secondary claims and from the description of the drawings which are appended to the present document and which illustrate, by way of nonlimiting examples, the method and particular embodiments of the device according to the invention.

FIG. 1 diagrammatically represents the main constituent elements of a tightening wrench which can be employed in the method according to the invention.

Figure 2:
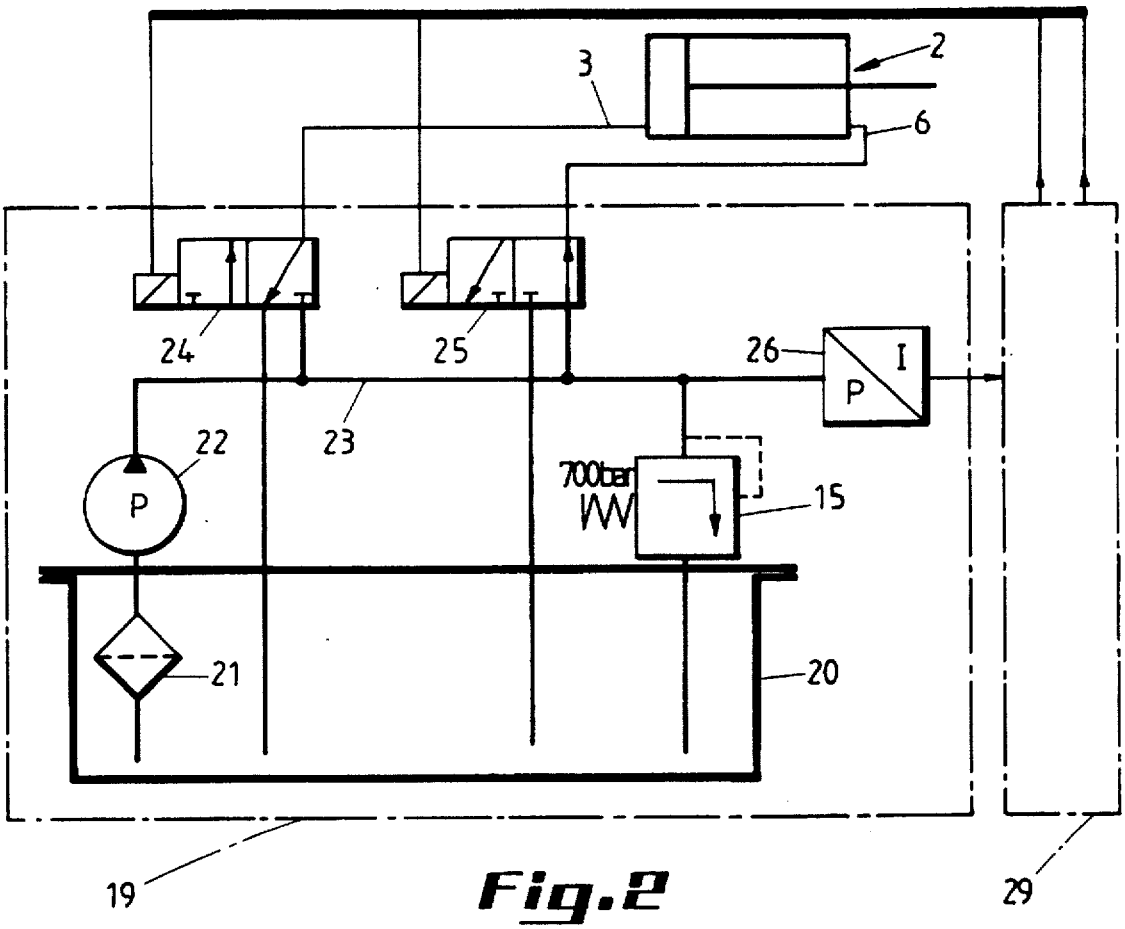

FIG. 2 diagrammatically represents a system of hydraulic and electronic controls for the hydraulic cylinder of FIG. 1.

Figure 3:
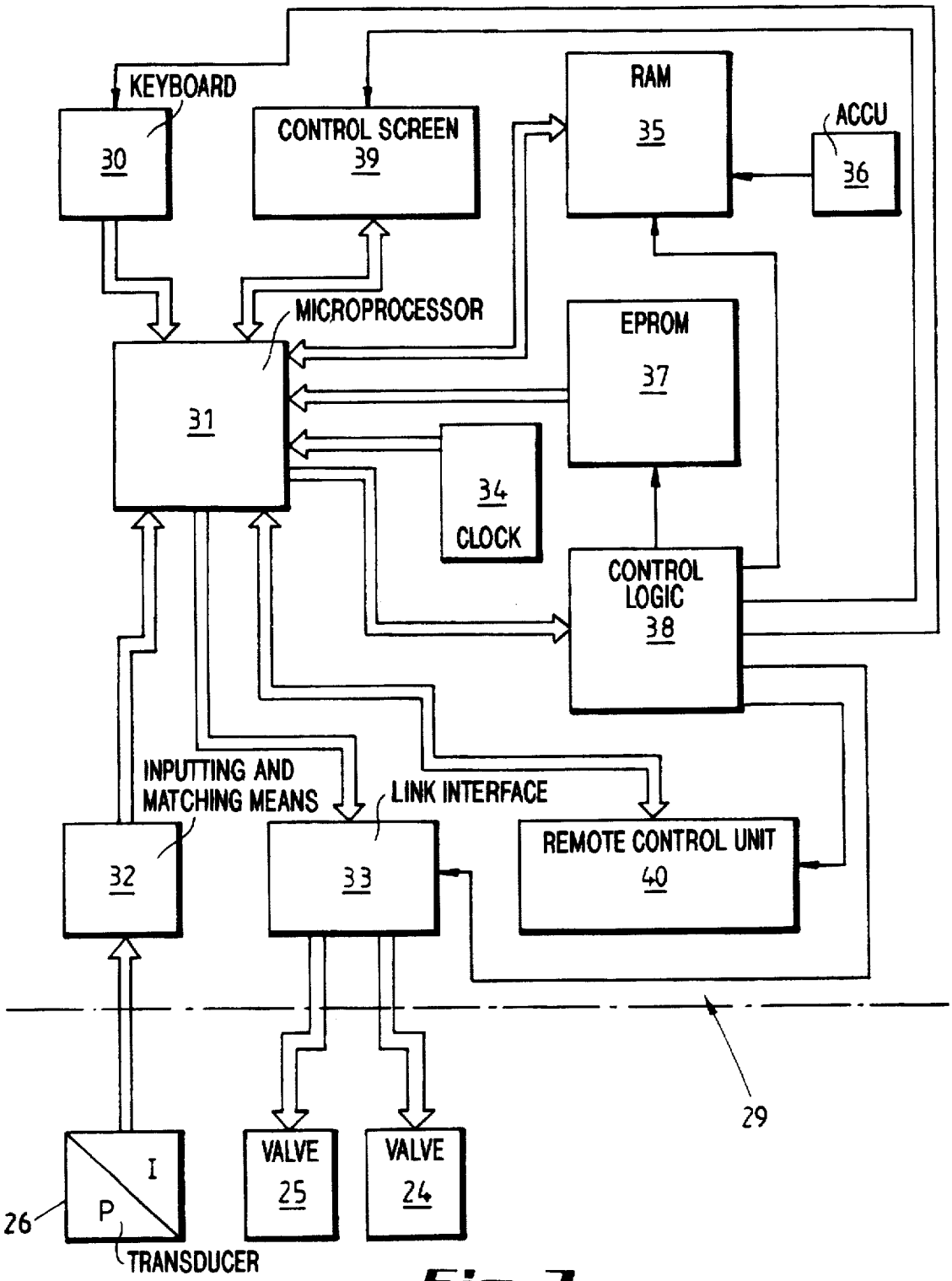

FIG. 3 represents a functional diagram of the electronic part of the control system of FIG. 2.

In the various figures, the same reference notations designate identical or similar elements.

In the case of the example (FIG. 1) of the abovementioned hydraulic tightening wrench 1, a double-acting cylinder 2 is actuated by the pressurized oil via an inlet 3 for the active stroke in the direction 4 of displacement of a piston 5 and via an inlet 6 for the passive stroke in the direction 7 of the return of the piston 5 for the purpose of a further active stroke.

According to the diagram in FIG. 1, during an active stroke in the direction 4, a rod 8 fixed to the piston 5 pushes, by means of its free end 9, directly or indirectly, a tooth 10 of a ratchet wheel 11, along a circle of radius R, so that said wheel rotates by a value corresponding to the length of the active stroke, for example in the direction for tightening a nut (not shown) housed in an appropriate recess 12 in the ratchet wheel 11. A nonreturn panel 13 and its spring 14 are also shown in this diagram: they prevent the wheel 11 from accompanying the rod 8 in its return stroke in the direction 7. A to-and-fro movement of the piston 5 is repeated in order in this way to rotate the ratchet wheel 11 and therefore the nut until the latter opposes said tightening with a desired resisting torque Cr. In order to end up not exceeding this resisting torque Cr, it is necessary to limit the force F supplied by the piston 5 so that it is at most equal to the resisting force Fr (equal to Cr/R). For this purpose, the pressure P on the piston 5, proportional to the force F to be supplied by the latter, is limited to a corresponding set value Pc by an electrical control device 29 (FIG. 2) which monitors this pressure via a pressure/current transducer 26, an explanation of which will be given hereinbelow.

According to the invention, after having selected the set pressure Pc in said electrical control device 29, the cylinder 2 is supplied with pressurized fluid via the inlet 3 in the active-stroke direction 4. During this stroke in the direction 4, the fact that the pressure of the fluid reaches the set pressure Pc is detected. This detection may indicate that either the piston 5 has come into abutment at the end of its active stroke or the nut offers a desired resisting torque Cr. Following this detection, the cylinder is supplied in the reverse direction via the inlet 6 for the passive return stroke in the direction 7. The moment when the piston 5 comes into abutment at the end of its passive return stroke is detected by a suitable means. The time Te elapsed between the start of the supply with fluid via the inlet 6 and the moment when the piston 5 comes into abutment in said return stroke is measured for this return stroke. This elapsed time Te is compared with a determined time Td which corresponds to that of a complete return stroke under the same operating conditions of the cylinder 2 (for example for the same temperature and therefore the same viscosity of the oil used). If the time Te is substantially equal to the time Td, the piston 5 has made a complete return stroke and there is no certainty that the pressure Pc obtained at the end of the preceding active stroke corresponds to a desired tightening torque Cr of the nut. In this case, the tightening sequence, which each time includes a complete active stroke and a complete passive stroke and the detection, measurement and comparison operations, is repeated until the measured elapsed time Te is substantially less than the time Td.

In order to determine the moment when the piston 5 comes into abutment at the end of its return stroke in the direction 7, it is advantageous according to the invention to detect in this case too that the pressure of the fluid at the inlet 6 reaches or exceeds a determined pressure greater than that which is necessary for the piston to make this return stroke with certainty and regularity. This determined pressure may preferably be equal to the abovementioned pressure Pc which will then not be exceeded.

Rather than storing in memory one or more time values Td as a function of the temperature and therefore of the fluidity of the fluid used, it may be preferred, within an abovementioned tightening sequence, to take a reading of the elapsed time Tec, measured for a complete passive return stroke, and to record this time Tec in order to use it as the time Td for the following comparisons. This time Tec may be measured, for example, during one or two no-load operating sequences of the hydraulic clamping wrench 1 which are carried out, just before using the wrench, so as to put the latter and its control unit into a known initial state.

In order better to monitor the variation in fluidity of the fluid as a function of the variation in temperature, for example during a long continuous use of the clamping wrench 1, it may be advantageous to use, for each sequence (n) of aforementioned tightening (the return stroke of which is made at a time Te(n)), as the determined time Td, the value of the elapsed time Te(n−1) measured for the previous sequence (n−1). This may be carried out after having observed that the time Te(n−1) is not substantially less than an initial time Td or less than a preceding time Te(n−2).

In order to confirm that the tightening obtained corresponds to the chosen resisting torque Cr, it is desirable to repeat said tightening sequence once more, after a time Te(n) substantially less than the time Td has been measured. The new elapsed time Te(n+1) measured during this last tightening sequence may then also be compared with the time Td for a final confirmation. If, by chance, this new measured elapsed time Te(n+1) were not substantially less than the time Td, a signal could be given in order to warn of this anomaly so that the operator could check the situation either with regard to the tightened elements (for example failure of an element weaker than anticipated) or of the clamping wrench and of its control unit (for example the fluid being too hot).

In order to even out the fluctuations in the value of the time Tec used as the determined time Td in the comparison, it may be preferred to take, for example from a third abovementioned tightening sequence, an average of elapsed times Tec measured in preceding sequences and to use this average Tm as the time Td. For the aforementioned average Tm, it is possible, for example, to neglect a first value of time Te substantially shorter than the previous one or ones and to stop repeating said tightening sequences only after the appearance of a second value of measured time Te substantially shorter the average Tm thus obtained.

In a simplified form a typical installation for implementing the abovementioned method may include, for example (FIG. 2), a hydraulic control part 19 comprising an oil reservoir 20 in which is submerged a suction filter 21 connected to the inlet of a pump 22, the outlet of which delivers the oil into a pipe 23. Branched off this pipe 23 is a pressure limiter 15 (for example set to 700 bar), a solenoid valve 24 for supplying the inlet 3 of the cylinder 2 and a solenoid valve 25 for supplying the inlet 6 of the same cylinder 2. Furthermore, a transducer 26, known per se, may be connected to the pipe 23 and is then chosen to give a current signal I as a function of the pressure P which it detects in the pipe 23.

The abovementioned installation may be equipped with the control device 29 of the invention, this preferably being an electronic control device with a microprocessor, one embodiment of which is shown in FIG. 3 by way of example.

The control device 29 may comprise, in addition to a supply, not shown, means in the form of an input keyboard for the selection 30 of a set pressure Pc for the fluid, as a function of the maximum force F desired during at least the active stroke in the direction 4 of the piston 5. The keyboard 30 is connected to means of comparison 31 which may consist of an eight-bit microprocessor 31. Connected to the microprocessor 31 is a means of inputting and matching 32 of a signal corresponding to the pressure supplied to the cylinder 2 during its active stroke in the direction along the arrow 4 and preferably also during its passive stroke in the direction along the arrow 7, this signal being supplied, for example, by the aforementioned transducer 26. The microprocessor 31 may selectively control the cylinder 2 by means of the aforementioned solenoid valves 24 and 25, via a link interface 33. In the case of the example shown here, the end of the return stroke along the direction of the arrow 7 is detected, here too, with the aid of the transducer 26. A real-time clock 34 is connected to the microprocessor 31 for measuring the time Te elapsed between the start of the passive return stroke and the completion thereof. A RAM memory 35 connected to the microprocessor 31 serves to store in memory, inter alia, the determined time Td as well as other parameters and data of the system. This RAM memory 35 is supported by an accumulator 36 for safeguarding the value of the time Td and of these parameters and data. An EPROM memory 37 contains a program for operating the control device 29, the execution of which is timed by the clock 34. In addition, control logic 38 connected, according to FIG. 3, to the various elements of the device 29 ensures the timing of the data transfer between these elements.

A control screen 39, for checking the data input, the system parameters, etc., may be associated with the keyboard 30.

In order to make the system easy to operate, a remote-control unit 40 may also be provided for starting and (normal and/or emergency) stopping of the tightening system. This remote-control unit 40 may also include a display of, for example, the pressure reached at any moment or the torque actually attained during tightening.

According to the invention, the microprocessor 31 and the program are preferably designed also to compare the measured elapsed time Te with the determined time Td and to decide automatically to repeat a tightening sequence according to the abovementioned method as long as Te is substantially equal to Td and to stop any repetition when it is certain that Te is manifestly less than Td.

Although the transducer 26 has been considered here as being external to the control device 29 as such, there may be cases where it is preferred to include it therein.

A typical operation of a tightening assembly equipped with the present system 29 is carried out as follows.

The set pressure Pc is input into the device 29 via the keyboard 30 and a tightening sequence is initiated via the remote-control unit 40. The microprocessor 31 executes a program which enables the piston 5 of the wrench 1 to be set in motion, while at the same time, by means of the transducer 26, measuring the oil pressure P in the hydraulic circuit (the pipe 23).

The movement of the piston 5 is a to-and-fro movement repeated according to the program of the EPROM memory 37, the direction of displacement of the piston 5 being reversed at each increase in the oil pressure above the preset threshold Pc.

When the piston 5 comes to the end of the active stroke, it usually takes a time Tec for the return stroke which is greater than a time Te for a return stroke from any position which it might have reached before the end of the active stroke during tightening of a nut or a bolt to the desired torque Cr.

The to-and-fro movement of the piston 5 is then stopped when the microprocessor 31 has observed that the desired tightening torque has actually been attained. The tightening torque actually attained may be displayed on the remote-control unit 40, allowing the user to monitor the development of the tightening.

It should be understood that the invention is in no way limited to the embodiments described and that many modifications may be made to them without departing from the scope of the present invention.

For example, in order to take into account the size of the tightening wrench (working section of the piston 5, radius R on the ratchet wheel 11, etc.), different values of parameters of this kind may be stored in memory in the device 29 and selected, for example by a code, depending on the model and/or on the size of the wrench, for example one used at a given moment with this device 29 which may be mounted on a hydraulic control unit 19 common to several wrenches.

In addition, the device 29, may be equipped with a manually or automatically operating selection device for enabling the user himself to decide whether or not to stop the sequences of tightening an element or to undertake a multiple repetition of these sequences, even after obtaining the desired tightening torque.

Other means of adapting the time Td as a function of the temperature of the oil in service may be used. For example, Td values as a function of measured temperature may be stored in memory and the appropriate Td value may be selected by the microprocessor 31 responsible, for example, for also locking the tightening assembly should the temperature of the oil not be within chosen limits.

What is claimed is:

1. A method for controlling a double-acting cylinder actuated by a fluid under pressure in an assembly and a control unit for said assembly in which a to-and-fro movement of a piston may be repeated, an active stroke of said piston providing a desired maximum force in one direction and a passive stroke in a direction opposite to said one direction, said passive stroke causing said piston to return for a repetition of said strokes, said method comprising the steps of:

(a) selecting a set pressure for the fluid, corresponding to the desired maximum force;

(b) supplying the cylinder with pressurized fluid acting in the direction of the active stroke;

(c) detecting, during the active stroke, when the pressure of the fluid reaches the set pressure;

(d) following said detection, reversely supplying said pressurized fluid to the cylinder, for causing the passive return stroke;

(e) detecting a moment when the piston has completed its passive return stroke;

(f) measuring an elapse of a time period between the start of the reversed supply and a detection of a completion of the passive return stroke;

(g) comparing said elapsed time period with a time period determined as corresponding substantially to a time of a complete passive return stroke; and (h) repeating the above sequence, until at least said measured elapsed time is substantially less than the determined time.

2. A method as claimed in claim 1, wherein step (c) of the method comprises detecting the moment when the piston has completed its passive return stroke, and the further step of detecting when the pressure of the fluid reaches at least the set pressure.

3. A method as claimed in claim 1, wherein step (f) of the method further comprises the step of reading, within at least one of said sequence, said elapsed time, measured for a complete passive return stroke, and using this read elapsed time as the determined time for the comparison of step (g).

4. A method as claimed in claim 1, wherein, step (g) for making the comparison, each elapsed time is measured for a passive return stroke and is compared with the preceding passive return stroke which is used as the determined time.

5. A method as claimed in claim 1, further comprising the steps of detecting a third of the sequences repeated in step (h), said determined time being an average value of elapsed times found in step (f) which are measured in preceding ones of the sequences of step (h), eliminating a measurement of a first elapsed time which is substantially shorter than the preceding ones, and stopping the repetition of the sequence responsive to an appearance of two successive measurements of a substantially shorter elapsed time.

6. A method as claimed in claim 1, wherein said repeated sequence of step (h) is repeated once more after the comparison of step (g) is a measured elapsed time which is substantially shorter than the determined time, the elapsed time measured in step (f) during a last repetition of the sequence of step (h) being compared with the determined time, and giving a signal if this last measured elapsed time is not substantially shorter than the predetermined time.

7. A device for implementing a method of controlling a double-acting cylinder actuated by a fluid under pressure in an assembly, and a control unit for said assembly in which a to-and-fro movement of a piston may be repeated, an active stroke of said piston providing a desired maximum force in one direction and a passive stroke, in a direction opposite to said one direction during the active stroke for causing said piston to return for a repetition sequence of said strokes, said device comprising:

means for selecting a set pressure for the fluid, as a function of a maximum force desired during an active stroke of the piston in the cylinder;

means connected to the selecting means for comparing a set pressure to a pressure of the fluid during at least one of the active stroke of the piston and the passive return stroke, and the set pressure;

means connected to the comparing means for inputting and matching a signal indicating the pressure supplied to the cylinder during at least one of the active stroke and the passive return stroke;

means connected to the comparing means for selectively controlling the cylinder during the active stroke and for the passive return stroke;

means connected to the comparing means for detecting the end of the passive return stroke;

means connected to the comparing means for measuring an elapsed time period between a start of the passive return stroke and a completion thereof; and means connected to the comparison means for storing in a memory a time period determined as corresponding substantially to a time of a complete passive return stroke.

8. A device as claimed in claim 7, wherein the comparing means further comprise means for comparing the measured elapsed time and the determined time and responsive thereto deciding whether to have an automatic repetition of a sequence of the method if the measured elapsed time is substantially equal to the determined time.

9. A device as claimed in claim 7, further comprising means for measuring the pressure supplied to the cylinder during at least one of its active stroke, and its passive return stroke, and means for converting this measurement into the signal.

* * * * *